US005365675A

United States Patent [19]

Shabram, Jr.

[11] Patent Number: 5,365,675

[45] Date of Patent: Nov. 22, 1994

[54] EXPANDABLE STRUT FOR HOLDING TENNIS SHOES IN A DRYER

[75] Inventor: Lyle F. Shabram, Jr., Salinas, Calif.

[73] Assignee: Paul Anthony Palumbo, Monterey, Calif.

[21] Appl. No.: 226,269

[22] Filed: Apr. 11, 1994

[51] Int. Cl.[5] ..... F26B 11/02

[52] U.S. Cl. ..... 34/109; 34/600; 34/239

[58] Field of Search ..... 34/109, 595, 600, 599, 34/602, 604, 237, 238, 239, 240

[56] References Cited

U.S. PATENT DOCUMENTS

| | | | |
|---|---|---|---|
| 2,298,352 | 10/1942 | Downes | 34/109 |
| 3,316,659 | 5/1967 | Lauck | 34/133 |
| 4,091,548 | 5/1978 | Daily | 34/133 |
| 4,109,397 | 8/1978 | Daily | 34/239 |
| 4,467,535 | 8/1984 | Hardison | 34/109 |
| 4,617,743 | 10/1986 | Barnard | 34/109 |
| 4,702,016 | 8/1986 | Grigsby | 34/33 |
| 4,813,641 | 5/1987 | Wilson | 248/206 |
| 5,220,734 | 6/1993 | Carver | 34/600 |
| 5,276,979 | 1/1994 | Gordon, Sr. | 34/109 |

*Primary Examiner*—Denise L. Gromada
*Attorney, Agent, or Firm*—David Pressman

[57] ABSTRACT

A more economical, efficient, portable and versatile apparatus for drying tennis shoes within rotary drum dryers, which comprises a fixed main tube (11), a pair of telescoping members (12), a pair of heel support crossbars (14), and an urging means (20) that interact to provide a platform with an automatic compression and expansion range. The apparatus can be used in various sizes of home and commercial dryer drums. Tennis shoes are fastened directly to the apparatus by inserting a shoe toe into a continuous angular loop (18). The user can secure a predetermined size shoe 23 to heel support crossbar (14) by attaching a flexible cord component (19) and heel clip (16). The heel clip (16) is attached to a back spine area of a predetermined tennis shoe, and the resulting pressure leverages the toe of the shoe against a strut (17). Tennis shoes are held in a balanced, open fashion, which facilitates greater circulation of air flow through both inner, and outer portions of shoes, and provides a more efficient drying system. When braced against the sides of a dryer drum, the drum rotates the tennis shoes directly through a central, heated air treatment zone without noise, material damage, and tangling. The device can be used in concert with freely tumbling items placed within the dryer drum.

18 Claims, 4 Drawing Sheets

EXPANDABLE STRUT FOR HOLDING TENNIS SHOES IN A DRYER

BACKGROUND

1. Field of the Invention

This invention relates to drying and dryers, particularly to a new and superior method of drying tennis shoes.

2. Prior Art

Over time, inventors have developed a diverse assortment of insertable dividers, platforms (magnetized and suction varieties), baskets, compartments, and racks that fit into rotating dryer drums to facilitate the drying of tennis shoes and other clothing items more effectively. The principal aim of these devices has been to dry tennis shoes and other items efficiently and quickly, but without noise, damage, and tangling.

For example, U.S. Pat. No. 4,617,743 to Barnard (1986) discloses an insertable, telescoping rod with an accompanying attachable/detachable container for holding tennis shoes and other items within a dryer drum. The rod possesses a manually-operable mechanism, so it must be manually adjusted for differing drum sizes upon insertion.

Items to be dried are placed into a holding container, which is then attached to a support rod, and inserted into a drying drum. The container compartment is magnetized, and can be attached to dryer drum walls if desired. In either case, circulating air flow is restricted since the shoes are always enclosed in a container.

In addition, when the drying container is attached to the insertable support rod, Barnard's complete device could become unstable, since the container's weight is not equally distributed on the rod, and therefore is out of balance. Performance of the device is further limited because the rod and attached container tend to displace substantial dryer drum volume when inserted, and are likely to interfere with other items to be dried.

Finally, its circular, non-skid grip components are not well suited for establishing a secure seat when set against substantially curved dryer drum walls, which can result in apparatus slippage or creep while the drum is rotating. Device creep can lead to unwanted detachment during operation. Device detachment may also occur when contact is made with other tumbling items moving freely within the drum.

Drying baskets are shown in U.S. Pat. Nos. 4,091,548 to Daily (1978), 4,109,397 to Daily (1978), and 3,316,659 to Lauck (1967). These exhibit functional limitations since each is rectangular in shape and is not designed to be used in conjunction with other items to be dried.

Additionally, Daily's devices cannot be used in dryers where drum paddles for support rod attachment are absent, or in commercial dryer drums. Furthermore, Daily's and Lauck's devices do not enable suspended items to be rotated in a substantially circumferential manner. This tends to reduce exposure to heated air, and negates the benefits of a rotating dryer drum. Lauck discloses no means for rotating items whatsoever.

The device of U.S. Pat. No. 4,702,016 to Grigsby et. al. (1986) shows a dryer drum wall attachment device. The number of shoes and items that can be fixedly rotated is relatively small. In addition, the device disclosed by Grigsby is magnetized, requiring direct dryer drum wall placement. Therefore, tennis shoes can be rotated only in proximity to the dryer drum's walls, and shoes are not passed directly through a central heated treatment zone where maximum drying efficiency is assured.

U.S. Pat. No. 4,813,641 to Wilson (1987) shows a device which also attaches to dryer drum walls, but the attachment cup is unstable, and capable of holding one shoe only. Further, the device could not be used in commercial laundry establishments because installed commercial dryers typically have drums that are perforated, which lessens the drum surface area necessary to ensure the cup can effect a secure seat.

U.S. Pat. No. 4,467,535 to Hardison (1983) shows an insert device that separates tennis shoes and other laundry items, but the device does not suspend the shoes, or eliminate noise.

OBJECTS AND ADVANTAGES

Accordingly, several objects and advantages of the present invention are:

to provide an improved apparatus for drying multiple tennis shoes, an improved apparatus for holding multiple tennis shoes in a dryer drum, an improved apparatus for holding multiple tennis shoes between opposing sides of rotating dryer drums, exposing multiple tennis shoes to maximum levels of heated air within a dryer drum, provide an apparatus that can automatically fit various sizes of home dryer drums within its inner and outer telescoping limits, that can be securely braced between the sides of dryer drum walls, and as the drum rotates, circumferentially pass attached tennis shoes through a heated treatment zone without noise, material damage, or tangling, provide a holding strut for rotating multiple tennis shoes in a dryer drum, which can effectively function with freely tumbling clothing items to dried, without undue interference to those items, provide a holding strut that can automatically adjust to various sizes of commercial dryer drums, provide a holding strut capable of an infinite number of automatic, braced wall placement settings within its telescoping operating range, enable tennis shoes to be dried in a manner that exposes inner and outer sections of shoes to maximum levels of heated, circulating air, provide a holding strut that has a shoe support platform that can accommodate a wide range of shoes, from children to adult sizes automatically, and without additional attachments, provide a holding strut for tennis shoes with heel support crossbars capable of a pivoting adjustment range, provide an improved apparatus for drying tennis shoes that eliminates the need for converting or segmenting a rotating dryer drum to separate freely tumbling clothing items from tennis shoes, and can employ a variety of fastening devices for attaching items directly to its tubular members, including, but not limited to, belts, buckles, snaps, hook and loop components, flexible cord, grommets, straps, heel clips, clamps, single operating jaws or combinations thereof.

Further objects and advantages are to provide such a device that is durable, inexpensive, non-toxic, colorable, easy to use, attractive, lightweight, contains minimal components, and is constructed of heat-resistant plastics that are safe and sufficiently resistant to heat deflection when used in drying machines operating at elevated temperatures.

Still further objects and advantages are to provide an apparatus that is stable and secure when braced in a dryer drum.

Figure 1:
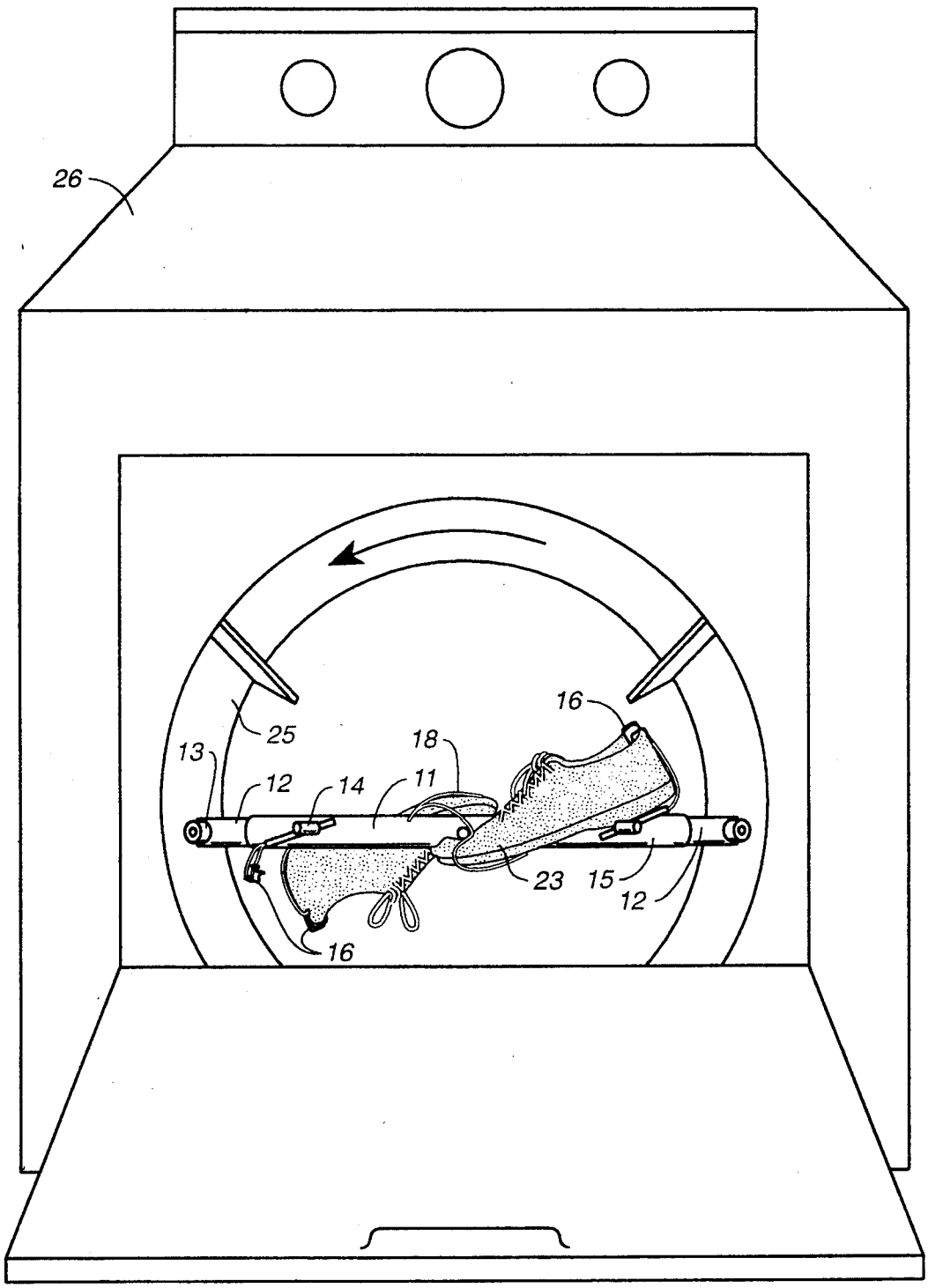
FIG. 1 is a perspective view of a dryer with the door open, and showing a shoe-holding apparatus according the present invention, and braced between opposing sides of dryer drum walls.

| Reference Numerals | | | |
|---|---|---|---|
| 11 | Central support tube | 12 | telescoping tube |
| 13 | Padded circular foot | 14 | Crossbar, spring buttress |
| 15 | Heel Support pin, cord guide | 16 | Heel clip (wire variation) |
| 17 | Toe support strut | 18 | Angular loop, toe harness |
| 19 | Heel clip attachment cord | 20 | Compression spring |
| 21 | Stabilizing post, retaining peg | 22 | Bored guide slot |
| 23 | Tennis shoe | 24 | Central tube thread hole |
| 25 | Internal dryer drum wall | 26 | Rotary drum dryer |
| 27 | Plated heel clip variant | 28 | Main tube through holes |
| 29 | Crossbar through holes | 30 | Toe strut through holes |
| 31 | Support pin through holes | 32 | Retaining peg through holes |

DESCRIPTION OF TENNIS SHOE HOLDING STRUT

FIG. 1 shows a device, holder, or apparatus for holding multiple tennis shoes within a dryer drum that rotates counterclockwise. If the dryer drum moved clockwise, the body of apparatus would be rotated 180 degrees. When shoes are attached to the present apparatus and placed into the dryer drum in the preferred manner, maximum drying efficiency is produced by exposing internal and external sections of the shoes to circulating air. Shoes are passed directly—and in a substantially circumferential manner—through a heated treatment zone with other items to be dried when the drum is rotated.

Figure 3:
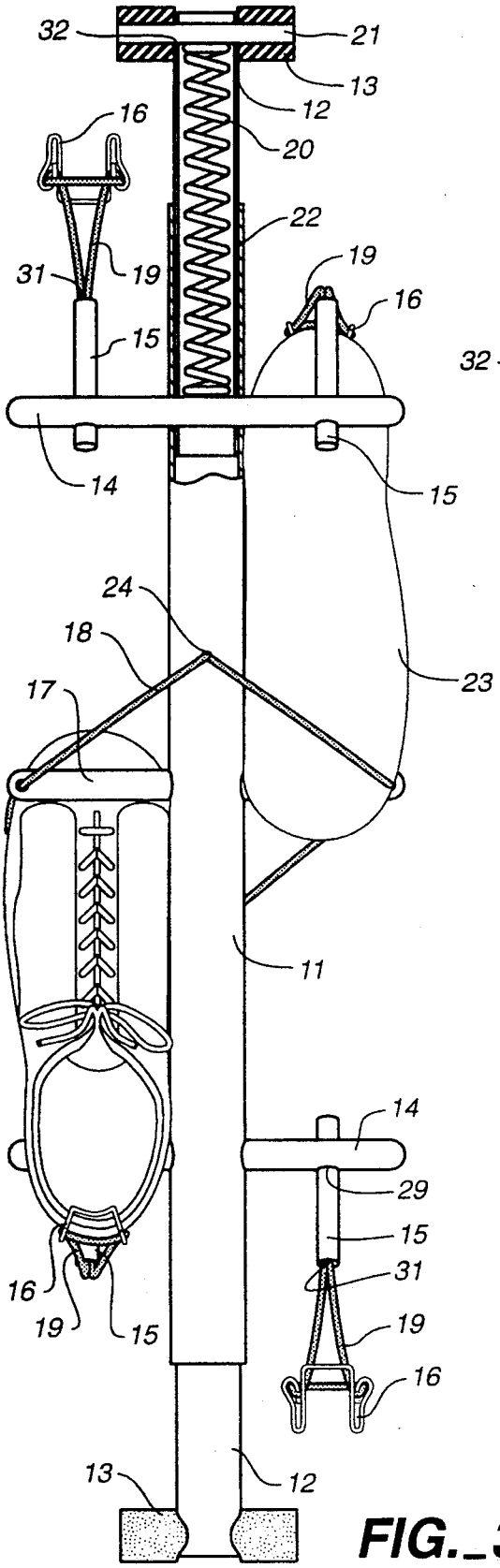
FIG. 3 is a top view of the apparatus with a cutaway section exposing a spring in a slidable tube, where the spring is dynamically placed between two fixed points.

The main body of the apparatus is constructed primarily from tubular, plastic components. Referring to FIG. 3, a center tube 11 is diametrically sized to receive two slidable tubes 12. Tubes 12 further contain guide slots 22 through which two heel support crossbar members 14 are inserted after two slidable tubes 12 are received in the open ends of central tube 11. A pair of heel support crossbars 14 are passed through main center tube 11 and guide slots 22, thereby creating a slidable, self-adjusting mechanism. A pair of heel support crossbars 14 are further capable of a pivoting action as illustrated in FIGS. 6 and 6A.

The mechanism's maximum, and minimum guide track establishes a working expansion and compression range that can extend rigidly between dryer drums with a range of diameters without manual adjustment.

During manufacture, tubes 12 with slots 22 are inserted into main, center tube 11, and aligned with evenly spaced through holes 28 (shown in FIG. 5) on center tube. This enables pivoting heel support crossbars 14 to be traversly inserted without obstruction.

Figure 6:
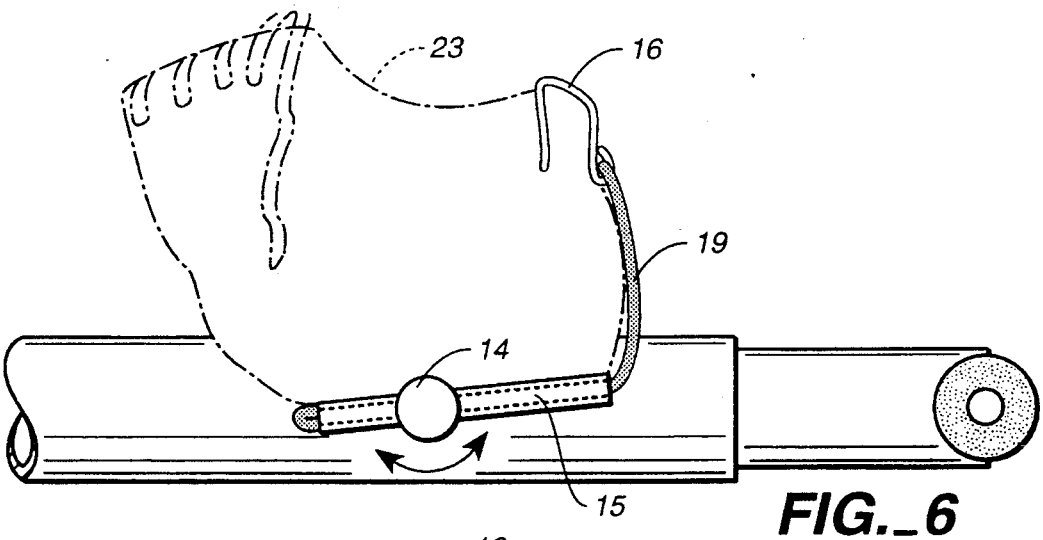
FIG. 6 is an enlarged view of one symmetrical end of the apparatus, illustrating radial movement capability of a heel support crossbar member and heel clip assembly.
Figure 6A:
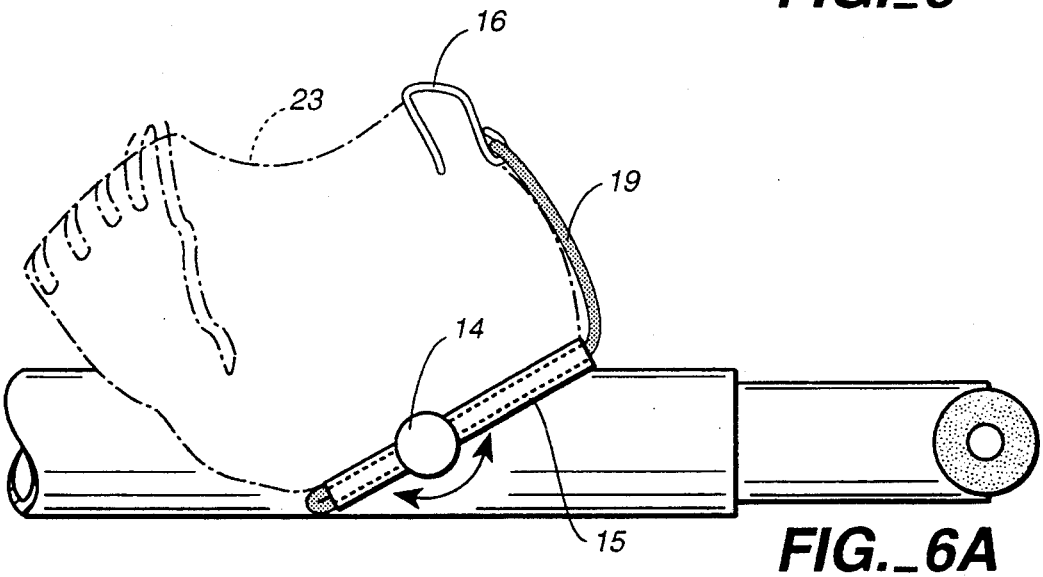
FIG. 6A is an enlarged view of one symmetrical end of the apparatus showing a steeper heel attachment angle.

Pivoting heel support crossbars 14, as depicted in FIGS. 6 and 6A, can accommodate a wide range of tennis shoe attachment angles, as defined by the depth of predetermined shoe toe and sole, and a corresponding slope when the shoe heel is set on the heel support crossbars with installed support pins 15. Heel support crossbars 14 pivot up to the sole of tennis shoe 23, and arrive at the optimum support angle by manual operation of heel clip 16 and flexible cord 19 during the process of shoe attachment.

Figure 4:
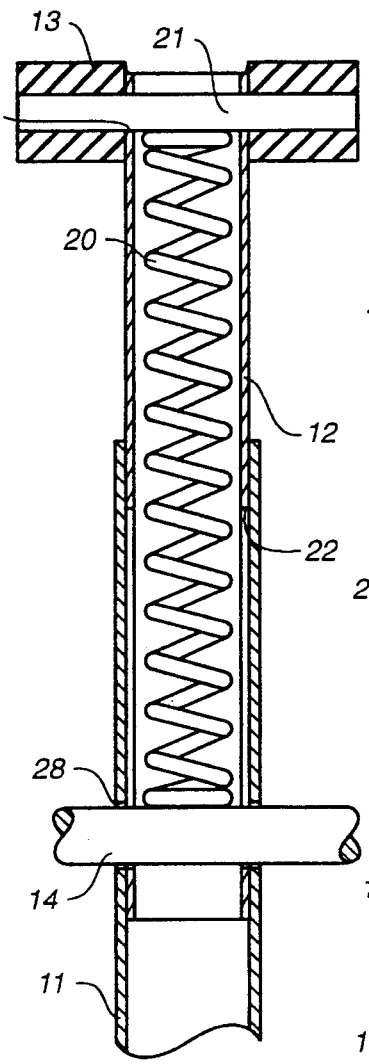
FIG. 4 is an enlarged, cutaway top view of one end of the apparatus, further illustrating a telescoping mechanism.

Springs 20 are inserted into diametric open ends of slidable tubes 12, and are buttressed against pivoting heel support crossbars 14, as best shown in FIG. 4.

Figure 5:
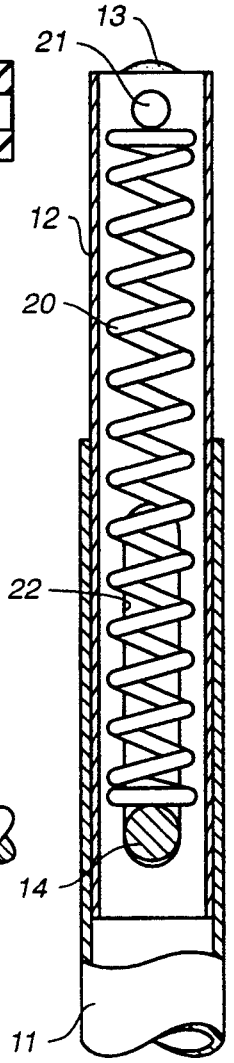
FIG. 5 is a cross-sectional view of the telescoping mechanism, and showing a bored sliding track (slot) cut into a telescoping tube member.

Springs 20 are then moderately compressed, allowing traverse insertion of linear support posts and retaining pegs 21, which are routed through sufficiently sized bored through holes 32 on tubes 12, as shown in FIGS. 4 and 5. Linear support posts and retaining pegs 21 are further capable of receiving padded, resilient, and cylindrical padded feet 13.

Springs 20 are of sufficient length to maintain constant outward pressure against linear support posts and retaining pegs 21. The springs thus urge telescoping, slidable tubes 12 to remain at their most outwardly extended position.

Cylindrical padded feet 13 establish at least four points of frictional, linear tangency against inner dryer drum walls 25, as shown in FIG. 1. The multiple points of tangency enable the device to seat itself in a secure, braced manner between the diametrically opposed sides of the drum. Each pad 13 is resilient, and cylindrical so as to provide firm, non-slip contact with the drum. Preferably feet 13 are made of a material which can stand the heat within the drum; one suitable material is EPDM rubber.

Springs 20 against slidable tubes 12, pivoting support crossbars 14, and retaining pegs 21 provide constant, outwardly directed pressure. This effectively creates a set of firm contact points between dryer drum 25 and pads 13. The resulting frictional contact enables the establishment of a secure device seat.

Figure 2:
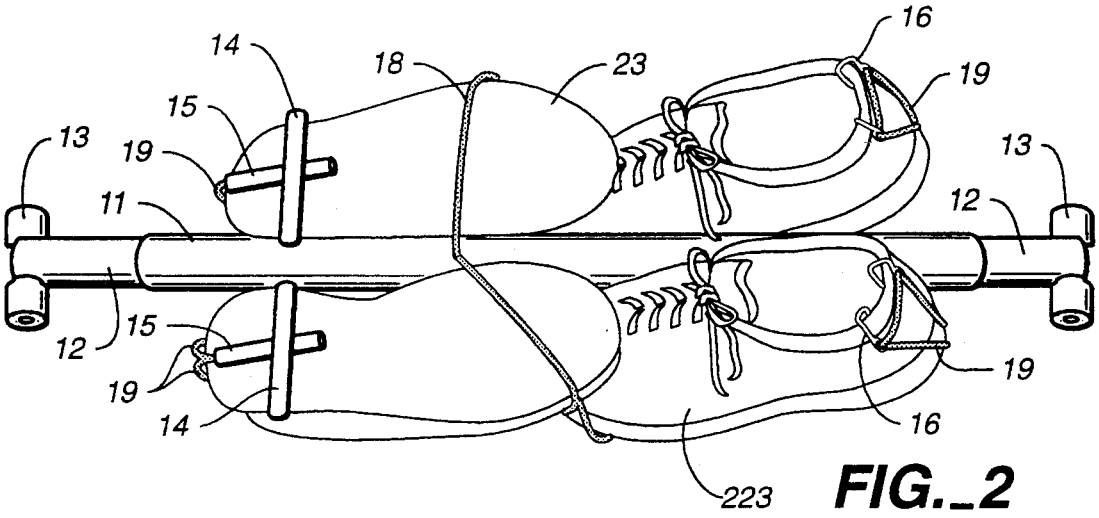
FIG. 2 illustrates a top view of the apparatus holding multiple shoes, prior to insertion into a dryer drum.

Pads 13 on pegs 21 form a lateral, stabilizing seat when pressed against drum wall 25. The seat prevents the apparatus from unwanted movement or slippage during rotation of the dryer drum. Additionally, the stabilizing mechanism minimizes apparatus creep when freely tumbling clothing items contact it. The seat also secures the apparatus from unwanted movement when subjected to increased weight stress when multiple, wet tennis shoes are attached, as illustrated in FIG. 2.

The various interacting components of the tubular apparatus are constantly urged outwardly. This causes cylindrical stabilizing posts 21 and pads 13 to seek a diametrically secure, braced seat between the opposing sides of the dryer drum. Further, the points of tangential contact compel the apparatus to seat squarely within the drum.

Tubes 12 with slots 22 interact with pivoting heel support crossbars 14 to prevent any destabilizing side movement between slidable tubes 12 and main tube 11 after the components are permanently inserted into main center tube 11.

Figure 7:
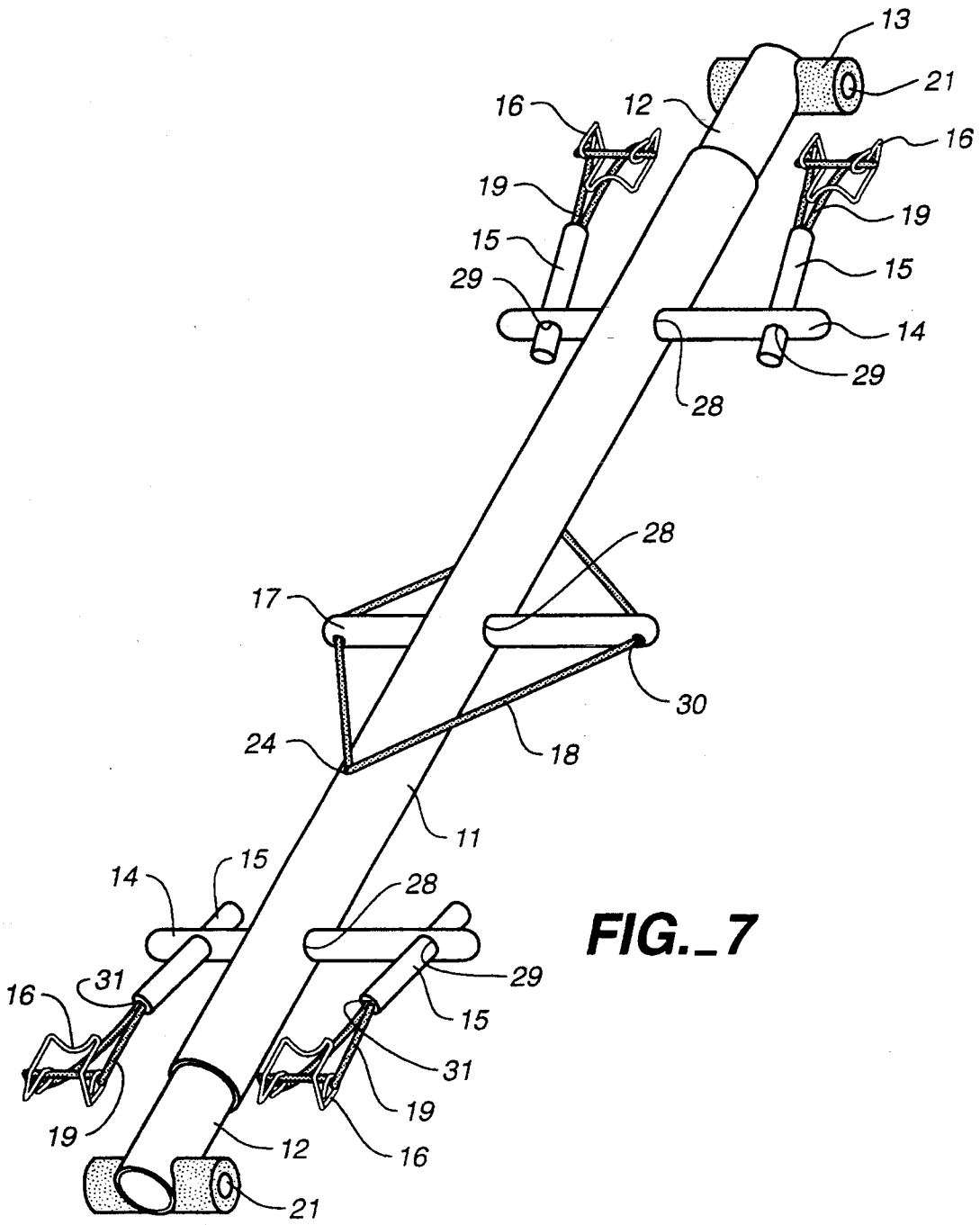
FIG. 7 is a full perspective view of the apparatus, showing two heel clip assemblies.

Returning to FIG. 3, main center tube 11 is further equipped with a shoe toe strut 17. An angular loop 18 is threaded through strut 17 via through holes 30. The angular loop 18 is further threaded through main center tube 11 at entry and exit points 24, and terminates at inward points of center tube 11. Terminal sections of cord segments 18 are joined and held at inward points of center tube 11 by conventional fasteners, and once complete, will result in a continuous angular loop, as illustrated in FIG. 7.

Bored heel support pins 15 are installed on pivoting heel support crossbar members 14 at equal distances from center tube 11, and provide increased surface area to accommodate larger and smaller size shoes. In addition, support pins 15 contain a bored routing path 31 for receiving heel clip cord segments 19. Heel clips 16 are then attached to cord segments 19. Heel support pins 15 also aid in centering and stabilizing the heel (rear) sections of tennis shoe 23 by ensuring a snug fit on a predetermined curved shoe spine by a correspondingly shaped heel clip 16, as shown in FIG. 6.

Figure 8:
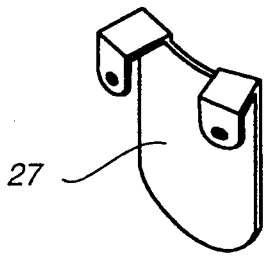
FIG. 8 shows a stamped, solid material heel clip variant.

In their preferred embodiment, heel clips 16 are constructed from wire forms, but can also be constructed of other materials, including molded plastic or stamped metal (as shown in FIG. 8). The design of heel clips 16, however, is such that the clips conform to the curvature of a back spine portion of a predetermined tennis shoe 23, and do so without distorting the original shape of the shoe.

Returning to FIG. 2, a shoe 23, and up to three additional shoes as indicated, can be firmly secured to the apparatus by interaction of heel clips 16, toe strut 17, and a continuous angular loop 18. Heel clips 16 provide constant upwardly directed pressure when each shoe is leveraged against the bottom of shoe toe strut 17. A continuous angular loop 18 prevents each shoe toe from side movement.

In effect, the entire shoe body is held in a balanced, secure, and open position. This exposes the shoes to maximum levels of heated air, thereby effecting greater drying efficiency.

Operation of Tennis Shoe Holding Strut

Referring to FIG. 7, to use the holding apparatus, the toe of tennis shoe 23 is inserted into continuous angular loop 18, and tucked under toe strut 17. The heel of shoe 23 is then set on heel support crossbar 14 and support pin 15. Heel clip 16 is then pulled up, and over the predetermined spine of shoe 23. The heel of shoe 23 remains centered on heel support crossbar 14 by means of support pin 15 and flexible cord 19.

Flexible cord 19 and clip 16 allow the user to attach large or small size shoes quickly. Clips 16 and flexible cord 19 can accommodate an extensive range of predetermined heel spine dimensions, while attachment pressure is constantly centered by means of support pin 15, cord segment 19 and clip 16.

If only one pair of shoes is to be dried, the apparatus is turned over, and the second shoe is attached to the opposite side of main tube 11, as shown in FIG. 3. This tends to balance total tennis shoe weight on equal sides of the apparatus.

Returning to FIG. 2, the apparatus is ready for dryer drum insertion. The apparatus is firmly placed against the back corner wall of dryer drum 25. Manual pressure is applied to lateral post 21 and padded feet 13 to compress telescoping members 12. The apparatus evenly compresses along a bored guide slot 22.

The compressed apparatus is then easily inserted into dryer 26, and ready for bracing between the opposing sides of drum wall 25. A pair of springs 20 provide a continuous opposing force. This urges telescoping members 12, lateral support posts 21 and padded feet 13 to seek a secure seat against the drum 25 when manually released.

Referring again to FIG. 1, dryer 26 rotates counterclockwise. The apparatus is braced between the opposing sides of drum wall 25 so that the open surfaces of shoe 23 move in a complementary counterclockwise track. If dryer 26 moves in a clockwise direction, the apparatus can be rotated 180 degrees to position the shoes in the optimum position. This placement in the drum tends to expose attached shoes to maximum levels of heated, circulating air.

The telescoping mechanism, as illustrated in FIGS. 4 and 5, enables the user to position the apparatus in a number of braced drum locations easily and quickly. For increased drying efficiency, the apparatus can be installed relatively close to air exit vents, which are typically situated on the rear, stationary wall of dryer 26.

Summary, Ramifications, and Scope

Accordingly, the reader will see that the expandable strut can be inserted into the drum easily and conveniently. It can be used to dry multiple tennis shoes without undue interference to other tumbling items to be dried. In addition, the strut possesses the capability to seat itself between opposing walls of various sizes of home and commercial dryer drums automatically. It also has a shoe attachment assembly that allows shoes to be held and exposed to maximum levels of heated air. Furthermore, the strut has the following additional advantages:

- It can be constructed of cost-effective plastics that are safe, resistant to heat, and can be compounded to accommodate a variety of high tensile applications.
- It can be constructed of strong, yet light plastic which can be easily colored as desired.
- It will allow multiple shoes to be dried in a rotating dryer drum without noise, tangling, and damage.
- It will expose attached shoes to maximum levels of heated, circulating air.
- It permits shoes to be directly, and fixedly attached to telescoping, tubular members quickly.
- It provides a versatile platform for holding tennis shoes in a rotating dryer drum that comprises minimal, interacting components.
- It provides a shoe drying platform that is secure when inserted into rotary drum dryers.
- It provides an apparatus that is completely portable, and can be particularly useful in commercial laundry establishments.
- It provides an apparatus that can be easily stored in a laundry basket, or affixed to a wall.

Although the description above contains many specificities, these should not be construed as limiting the scope of the invention but as merely providing illustrations of some of the presently preferred embodiments of this invention. For example, the holding strut can have other shapes, such as oval, rectangular, triangular, etc.; the shoe attachment assembly can employ straps, single operating jaws, hook and loop components, belts, buckles, or combinations thereof. In addition, the present apparatus can be constructed from different materials, including tube extrusions using polypropylene and polycarbonate plastics.

The end grip feet can have a rectangular or cube shape, and made from extruded or molded rubber compounds. The toe support strut and heel support crossbars can be rectangular or triangular, and can be extruded or injection molded as desired. The angular loop can have many shapes, including triangular, rectangular, oval and combinations thereof.

Thus, the scope of the invention should be determined by the appended claims and their legal equivalents, rather than by the examples given.

I claim:

1. An insertable and removable drying apparatus for enabling a plurality of tennis shoes to rotate in a secure and exposed fashion while diametrically braced between opposing sides of a rotary dryer drum, comprising:

a fixed main tube having an axis, and a plurality of through holes extending normal to said axis;

a plurality of pivoting heel support crossbars positioned in said respective through holes of said main tube;

a shoe toe support strut traversing said fixed main tube;

at least two movable tubes, each of which has a plurality of guide slots, each of which is sized so that it can be inserted into said fixed, main tube;

at least two retaining pegs and laterally extending stabilizer posts mounted onto said movable tubes at opposite ends thereof;

an urging means positioned between said pivoting heel support crossbars and said retaining pegs, said urging means arranged to urge said movable tubes to their most outwardly extended position;

a plurality of resilient pads mounted onto said respective laterally extending retaining pegs and stabilizer posts;

a means for attaching a plurality of tennis shoes to said pivoting heel support crossbars and said toe support strut; and a plurality of bored tubular pins connected to said pivoting heel support crossbars.

2. Apparatus as described in claim 1, further including a flexible cord member connected between said shoe toe support strut and said fixed main tube, said cord member forming a continuous, angular loop.

3. Apparatus as described in claim 1, further including a plurality of heel support pins and cord guides connected to said pivoting heel support crossbar members at equal, and opposite perpendicular angles with respect to said crossbars.

4. Apparatus as described in claim 1 wherein said flexible cord segments are routed through said heel support pins and said cord guides installed on said pivoting heel support crossbar members.

5. Apparatus as described in claim 1, further including a plurality of curved heel clips attached at a plurality of locations on said flexible cord segments, said clips each conforming to the curvature of a back spine area of a predetermined tennis shoe, each so as not to deform the shape of said shoe.

6. Apparatus as described in claim 1, further including a plurality of curved heel clips attached at a plurality of locations on said flexible cord, said clips formed from solid material, each conforming to the curvature of a back spine area of a predetermined tennis shoe so as not to deform the shape of said shoe.

7. The apparatus of claim 1 wherein said resilient pads are cylindrical.

8. An insertable and removable drying apparatus for enabling a plurality of tennis shoes to rotate in a secure and exposed fashion while diametrically braced between opposing sides of a rotary dryer drum, comprising:

a fixed main tube having an axis, and a plurality of through holes extending normal to said axis;

a plurality of pivoting heel support crossbars positioned in said respective through holes of said main tube;

a shoe toe support strut traversing said fixed main tube;

at least two movable tubes, each of which has a plurality of guide slots, each of which is sized so that it can be inserted into said fixed, main tube;

at least two retaining pegs and laterally extending stabilizer posts mounted onto said movable tubes at opposite ends thereof;

an urging means positioned between said pivoting heel support crossbars and said retaining pegs, said urging means arranged to urge said movable tubes to their most outwardly extended position;

a plurality of resilient pads mounted onto said respective laterally extending retaining pegs and stabilizer posts;

a means for attaching a plurality of tennis shoes to said pivoting heel support crossbars and said toe support strut;

a plurality of bored tubular pins connected to pivoting heel support crossbars; and a flexible cord member connected between said shoe toe support strut and said fixed main tube, said cord member forming a continuous, angular loop.

9. Apparatus as described in claim 8, further including a plurality of heel support pins and cord guides connected to said pivoting heel support crossbar members at equal, and opposite perpendicular angles with respect to said crossbars.

10. Apparatus as described in claim 8, wherein said flexible cord segments are routed through said heel support pins and said cord guides installed on said pivoting heel support crossbar members.

11. Apparatus as described in claim 8, further including a plurality of curved heel clips attached at a plurality of locations on said flexible cord segments, said clips each conforming to the curvature a back spine area of a predetermined tennis shoe, each so as not to deform the shape of said shoe.

12. Apparatus as described in claim 8, further including a plurality of curved heel clips attached at a plurality of locations on said flexible cord, said clips formed from solid material, each conforming to the curvature of a back spine area of a predetermined tennis shoe so as not to deform the shape of said shoe.

13. The apparatus of claim 8 wherein said resilient pads are cylindrical.

14. An insertable and removable drying apparatus for enabling a plurality of tennis shoes to rotate in a secure and exposed fashion while diametrically braced between opposing sides of a rotary dryer drum, comprising:

a fixed main tube having an axis, and a plurality of through holes extending normal to said axis;

a plurality of pivoting heel support crossbars positioned in said respective through holes of said main tube;

a shoe toe support strut traversing said fixed main tube;

at least two movable tubes, each of which has a plurality of guide slots, each of which is sized so that it can be inserted into said fixed, main tube;

at least two retaining pegs and laterally extending stabilizer posts mounted onto said movable tubes at opposite ends thereof;

an urging means positioned between said pivoting heel support crossbars and said retaining pegs, said urging means arranged to urge said movable tubes to their most outwardly extended position;

a plurality of resilient pads mounted onto said respective laterally extending retaining pegs and stabilizer posts;

a means for attaching a plurality of tennis shoes to said pivoting heel support crossbars and said toe support strut;

a plurality of bored tubular pins connected to said pivoting heel support crossbars;

a flexible cord member connected between said shoe toe support strut and said fixed main tube, said cord member forming a continuous, angular loop, and a plurality of heel support pins and cord guides connected to said pivoting heel support crossbar members at equal, and opposite perpendicular angles with respect to said crossbars.

15. Apparatus as described in claim 14 wherein said flexible cord segments are routed through said heel support pins and said cord guides installed on said pivoting heel support crossbar members.

16. Apparatus as described in claim 14, further including a plurality of curved heel clips attached at a plurality of locations on said flexible cord segments, said clips each conforming to the curvature of a back spine area of a predetermined tennis shoe, each so as not to deform the shape of said shoe.

17. Apparatus as described in claim 14 further including a plurality of curved heel clips attached at a plurality of locations on said flexible cord, said clips formed from solid material, each conforming to the curvature of a back spine area of a predetermined tennis shoe so as not to deform the shape of said shoe.

18. The apparatus of claim 14 wherein said resilient pads are cylindrical.

* * * * *